United States Patent [19]

Pliefke

[11] Patent Number: 4,619,742

[45] Date of Patent: Oct. 28, 1986

[54] PROCESS FOR THE SIMULTANEOUS GRAINING AND CHROMIUM-PLATING OF STEEL PLATES AS SUPPORTS FOR LITHOGRAPHIC APPLICATIONS

[75] Inventor: Engelbert Pliefke, Wiesbaden, Fed. Rep. of Germany

[73] Assignee: Hoechst Aktiengesellschaft, Frankfurt am Main, Fed. Rep. of Germany

[21] Appl. No.: 751,538

[22] Filed: Jul. 3, 1985

[30] Foreign Application Priority Data

Jul. 4, 1984 [DE] Fed. Rep. of Germany ..... 3424528

[51] Int. Cl.[4] ..... C25D 11/38; C25D 5/36

[52] U.S. Cl. ..... 204/34; 204/129.9; 204/51

[58] Field of Search ..... 204/34, 35.1, 41, 51, 204/129.9, 144.5, 129.75; 101/395

[56] References Cited

U.S. PATENT DOCUMENTS

| | | | |
|---|---|---|---|
| 2,907,273 | 10/1959 | Geese | 204/51 |
| 2,939,826 | 6/1960 | Gulick | 204/34 |
| 3,041,257 | 6/1962 | Cope, Jr. et al. | 204/51 |
| 3,303,113 | 2/1967 | Romanowski | 204/51 |
| 3,929,591 | 12/1975 | Chu et al. | 204/129.9 |
| 3,951,759 | 4/1976 | Studer | 204/51 |
| 3,979,212 | 9/1976 | Peters et al. | 96/86 R |
| 4,234,396 | 11/1980 | Perakh et al. | 204/51 |
| 4,371,430 | 2/1983 | Ballarini et al. | 204/34 |
| 4,445,998 | 5/1984 | Kanda et al. | 204/34 |

FOREIGN PATENT DOCUMENTS

| | | | |
|---|---|---|---|
| 31590 | 9/1972 | Australia | 204/51 |
| 0020021 | 12/1980 | European Pat. Off. | 204/34 |
| 0097502 | 1/1984 | European Pat. Off. | 204/34 |
| 0097503 | 1/1984 | European Pat. Off. | 204/34 |
| 2081148 | 10/1970 | France | 204/51 |
| 0107497 | 6/1983 | Japan | 204/51 |

OTHER PUBLICATIONS

Soviet Inventions Illustrated, Section Ch:Chemical, Jul. 18, 1979, p. 25, SU 618-458.

Patent Abstracts of Japan, Apr. 7, 1983, vol. 7, No. 83, "Black Chrome Plating Method", 58-11792.

*Primary Examiner*—John F. Niebling

*Assistant Examiner*—Terryence Chapman

*Attorney, Agent, or Firm*—Schwartz, Jeffery, Schwaab, Mack, Blumenthal & Evans

[57] ABSTRACT

A process for producing chromium-plated, steel-based printing plate carriers comprises (A) simultaneously roughening and partially chromium-plating a substrate using alternating current in an electrolyte containing chromium, chloride, sulfate and, if appropriate, strontium ions and then, in the same electrolyte, (B) employing direct current to effect final chromium-plating. The printing plate supports produced in this manner have a uniform surface topography and peak-to-valley height values that are favorable for coating.

14 Claims, No Drawings

PROCESS FOR THE SIMULTANEOUS GRAINING AND CHROMIUM-PLATING OF STEEL PLATES AS SUPPORTS FOR LITHOGRAPHIC APPLICATIONS

BACKGROUND OF THE INVENTION

The present invention relates to a process for roughening and chromium-plating, in the same electrolyte, steel and steel-based plates for lithographic applications, e.g., in the production of offset printing plate supports.

Offset printing plates which, for simplicity, are hereinafter referred to as printing plates, are generally comprised of a support to which at least one radiation-sensitive reproduction layer is applied. The reproduction layer is applied to the support either by the user, in the case of plates which have not been precoated, or by the industrial manufacturer in the case of precoated (presensitized) plates.

The printing plate supports predominantly used comprise metallic materials, principally aluminum and its alloys. However, support plates of normal carbon steel or steel alloys, for example, chrome-nickel steels, manganese steels and the like, are also used.

In order to obtain certain necessary printing plate properties, such as an adhesive capacity for the layer, differentiation of hydrophilic and hydrophobic areas with defined behavior, corrosion properties and surface hardness, which is important for the length of the printing run, the printing plate is, in general, subjected to a pretreatment. This pretreatment includes, for example, a modification by mechanical, chemical or electrochemical roughening, which is also referred to as graining or etching, chemical or electrochemical surface oxidation, treatment with agents which confer hydrophilic properties, or heat hardening.

A combination of the above types of modification is frequently used in the modern, largely continuously operating high-speed units of the manufacturers of uncoated or precoated printing plates.

When aluminum or aluminum alloys are used, the modification comprises, in most cases, a combination of mechanical and/or electrochemical roughening and an anodic oxidation, followed, if appropriate, by a stage in which the plate is rendered hydrophilic.

Aluminum-based support plates are widely used and have proven largely satisfactory, even though, due to the material, they have a lower mechanical strength and wear resistance than steel plates. However, the aluminum-based carrier plates are not amenable to advantageous magnetic fixing to the printing cylinders. The desirable property of magnetic fixing is of particular interest for high-speed rotary presses.

In order to eliminate, in particular, this disadvantage, processes have been developed for the production of sandwich plates based on aluminum or steel, particular attention being paid to plates with chromium layers, because of their surface hardness. For example, German Offenlegungsschrift No. 2,544,295 discloses sandwich plates composed of a base support of aluminum or steel, on which printing and non-printing areas comprising two different metals are present. The printing areas mainly comprise copper, and the non-printing areas comprise chromium.

European patent application No. 20,021 discloses a process for the production of chromium-plated metal plates which are comprised, inter alia, of steel and which are used for lithographic purposes. The disclosed printing plate is produced by the following steps:

Initial cleaning
Rinsing
Roughening
Rinsing
Chromium-plating
Rinsing
Drying
Coating.

The roughening is carried out in a solution of bifluorides, and the cathodic chromium-plating is carried out in a bath of chromium oxide and sulfuric acid. The publication teaches that the conditions for the rinsing steps are critical, since otherwise uniform plates are not obtained.

European patent application No. 97,502 discloses the chromium-plating of steel plates as base supports for lithographic purposes, comprising the following steps:

Cleaning
Initial chromium-plating with direct current
Rinsing
Main Chromium-plating with direct current
Rinsing
Post treatment of the surface.

The initial chromium-plating is carried out in a bath of chromic acid and nitric acid, and the main chromium-plating is carried out in a bath of chromic acid and sulfuric acid, the current density and the temperature being higher in the second bath. The posttreatment of the surface is carried out using a solution of a water-soluble polymer, such as gum arabic, and a water-soluble salt, such as zinc acetate. Here again, the publication emphasizes that the rinsing steps are of special importance.

A similar multi-stage treatment for the production of chromium-plated steel plates is disclosed by European patent application No. 97,503. The essential difference between the aforesaid multi-stage treatment process and that disclosed by European patent application No. 97,502 concerns the individual bath compositions. The above-mentioned processes have the disadvantages that both are multi-stage processes and, in particular, that care must also be taken during the interposed rinsing steps. Moreover, the baths used in the individual stages must be very precisely matched, since otherwise the end products do not meet the demands of industry. Viewed as a whole, the known processes are expensive to implement and, as a result, lead to increased costs in the production of the plates.

Disposal of the spent baths, each of very different composition, and/or the rinsing water also engenders effluent problems. Moreover, the plates have peak-to-valley heights which are not optimal for anchoring the resist layer.

SUMMARY OF THE INVENTION

It is therefore an object of the present invention to provide a process for the production, for use in lithography, of a chromium-plated steel or steel-based support that is easy to handle, which process does not suffer from the above-mentioned disadvantages of the prior art.

It is also an object of the present invention to provide an offset printing plate support that displays, in addition to advantageous properties of hardness, corrosion resistance and the like, a surface topography having a roughness which is extremely favorable for receiving a resist layer.

In accomplishing the foregoing objects, there has been provided, in accordance with one aspect of the present invention, a process for preparing a chromium-plated steel or steel-based substrate suitable for use as a lithographic printing plate support comprising the steps of (A) electrochemically treating the substrate with alternating current in an acid electrolyte bath containing chromium ions, chloride ions and sulfate ions; and (B) in the same electrolyte bath, carrying out an electrochemical treatment of the substrate with direct current.

In accordance with another aspect of the present invention, there has been provided an offset printing plate support comprising a steel or steel-based substrate produced by a process comprising the steps (A) and (B).

Other objects, features, and advantages of the present invention will become apparent from the following detailed description. It should be understood, however, that the detailed description and specific examples, while indicating preferred embodiments of the invention, are given by way of illustration only, since various changes and modifications within the spirit and scope of the present invention will become apparent to those skilled in the art from this detailed description.

DETAILED DESCRIPTION OF PREFERRED EMBODIMENTS

The invention provides a process for the production of chromium-plated steel plates to be used for lithographic purposes, the steel plate being treated electrochemically in an acid bath containing chromium ions, which comprises treating the steel plate in an electrolyte, containing chromium ions, chloride ions, sulfate ions and, if appropriate, strontium ions, first with alternating current for roughening and partial chromium-plating and then, in the same bath, carrying out a treatment with direct current for final chromium-plating.

In the electrolyte of the present invention, the concentration of chromium ion is preferably between about 10 and 300 g/l, in particular between about 30 and 100 g/l; that of chloride ion between about 1 and 50 g/l; that of sulfate ion between about 0.1 and 10 g/l; and that of strontium ion between about 0 and 100 g/l. It is also preferred that the alternating-current density be between about 10 and 150 $A/dm^2$, in particular between about 30 and 100 $A/dm^2$. The direct-current density is optimally between about 10 and 70 $A/dm^2$. If necessary, an antifoam agent can also be added to the electrolyte.

The process according to the present invention is carried out either discontinuously or, preferably, continuously using strips or formats of steel or a steel-based alloy. In particular, the process parameters in a continuous process of the present invention are within the following ranges during the treatment step: temperature of the electrolyte is between about 20° and 60° C.; residence time in the electrolyte for a given segment of material is between about 10 and 300 seconds; and flow velocity of the electrolyte over the surface of the material is between about 5 and 100 cm/second. In discontinuous processes, the current densities are preferably in the lower portion, and the residence times in the upper portion, of the aforesaid ranges, respectively, and a flow of electrolyte is not absolutely necessary.

In accordance with the present invention, the electrochemical roughening and chromium-plating for producing steel or steel-based printing plate support material can be followed by one or more posttreatment steps. Posttreatment is understood here, in particular, as a chemical or electrochemical treatment which renders the steel support hydrophilic. Suitable posttreatments include, for example, an electrochemical treatment (anodizing) in an aqueous alkali metal silicate solution according to German Offenlegungsschrift No. 2,532,769; an immersion treatment in an aqueous alkali metal silicate solution according to German Offenlegungsschrift No. 1,471,707; and an immersion treatment in an aqueous polyvinylphosphonic acid solution according to German Offenlegungsschrift No. 1,621,478. These posttreatment steps have the particular purpose of additionally increasing the hydrophilic character, already adequate for many applications, of the support material while preserving other desirable properties thereof.

As used in this description, "steel" is understood to denote those steels which can be roughened and chromium-plated in the above-discussed electrolyte, i.e., both unalloyed and appropriately alloyed steels can be used in the present invention. Even though the process of the present invention is effective with steels of higher carbon content, particularly uniform roughenings are obtained for steels wherein the carbon content does not exceed 0.1%.

Layers suitable as light-sensitive reproduction layers to be applied to steel plates treated in accordance with the present invention include all those that, after exposure (and, if necessary, subsequent development and/or fixing) give an image-wise patterned surface, from which printing is possible and/or which represents a relief image of an original. These layers are applied to one of the conventional support materials, using known processes, either by the manufacturer of presensitized printing plates (or of so-called dry resists) or by the user directly.

The following light-sensitive reproduction layers are illustrative of those suitable for use in the present invention, and are described, for example, in "Light-Sensitive Systems" by Jaromir Kosar, John Wiley and Sons publishers, New York 1965: layers containing unsaturated compounds which are isomerized, rearranged, cyclized or crosslinked on exposure (Kosar, chapter 4); layers containing photopolymerizable compounds in which monomers or prepolymers are polymerized on exposure, possibly by means of an initiator (Kosar, chapter 5); and layers which contain o-diazo-quinones such as naphthoquinone-diazides, p-diazo-quinones and diazonium salt condensates (Kosar, chapter 7).

Suitable layers also include electrophotographic layers, i.e., those which contain an inorganic or organic photoconductor.

In addition to light-sensitive substances, light-sensitive layers used in the present invention can also contain other conventional ingredients, such as resins, dyes, pigments, wetting agents, sensitizers, adhesion promoters, indicators and plasticizers as auxiliaries. In particular, the following light-sensitive compositions or compounds can be used in the coating of carrier materials treated in accordance with the present invention.

Positive-working o-quinone-diazide compounds. preferably o-naphthoquinone-diazide compounds, which are described, for example, in German Pat. No. 854,890, No. 865,109, No. 879,203, No. 894,959, No. 938,233, No. 1,109,521, No. 1,144,705, No. 1,118,606, No. 1,120,273 and No. 1,124,817.

Negative-working condensation products of aromatic diazonium salts and compounds with active carbonyl groups, preferably condensation products of diphenylamine-diazonium salts and formaldehyde, which are described, for example, in German Pat. No. 596,731, No. 1,138,399, No. 1,138,400, No. 1,138,401, No. 1,142,871 and No. 1,154,123; in U.S. Pat. No. 2,679,498 and No. 3,050,502; and in British patent specification No. 712,606.

Furthermore, negative-working co-condensation products of aromatic diazonium compounds can be used, such as those disclosed in German Offenlegungsschrift No. 2,024,244 which contain at least one unit of each of the general types $(A\text{-}D)_n$ and B, linked through a divalent bridging member derived from a carbonyl compound capable of condensation. The aforesaid symbols are defined as follows: A is the radical of a compound which contains at least two aromatic carbocyclic and/or heterocyclic nuclei and which is capable, in an acid medium, of condensation with an active carbonyl compound in at least one position. D is a diazonium salt group linked to an aromatic carbon atom of A; n is an integer from 1 to 10; and B is the radical of a compound which is free of diazonium groups and which, in an acid medium, is capable of condensation with an active carbonyl compound in at least one position of the molecule.

Suitable positive-working layers include, for example, those taught by German Offenlegungsschrift No. 2,610,842 which contain a compound which splits off acid on exposure, a compound that has at least one C-O-C group which can be split off by acid (for example, an orthocarboxylate group or a carboxylic acid amide-acetal group) and, if appropriate, a binder.

Moreover, negative-working layers can be used which are composed of photopolymerizable monomers, photoinitiators, binders and, if appropriate, further additives. Examples of the monomers used in this context are acrylic acid esters and methacrylic acid esters or reaction products of diisocyanates with partial esters of polyhydric alcohols, as described, for example, in U.S. Pat. No. 2,760,863 and No. 3,060,023 and in German Offenlegungsschriften No. 2,064,079 and No. 2,361,041. Suitable photoinitiators include, inter alia, benzoin, benzoin ethers, polynuclear quinones, acridine derivatives, phenazine derivatives, quinoxaline derivatives and synergistic mixtures of various ketones. A large number of soluble organic polymers can be used as the binders, for example, polyacetal resins, polyamides, polyesters, alkyd resins, polyvinyl alcohol, polyvinylpyrrolidone, polyethylene oxide, gelatine and cellulose ethers.

Negative-working layers according to German Offenlegungsschrift No. 3,036,077 can also be used, which layers contain, as the light-sensitive compound, a diazonium salt polycondensation product or an organic azido compound and, as the binder, a high-molecular polymer having alkenylsulfonylurethane or cycloalkenylsulfonylurethane side groups.

Photo-semiconductor layers, such as are described, for example, in German Pat. No. 1,117,391, No. 1,522,497, No. 1,572,312, No. 2,322,046 and No. 2,322,047, can also be applied to the carrier materials, whereby highly light-sensitive, electrophotographic layers are produced.

The printing plate supports roughened and chromium-plated by the process according to the present invention have a uniform surface topography, which has a positive effect, with printing forms prepared using these carriers, on a steady run length and on hydrophilic plate properties during printing. Few "pits" (marked depressions relative to surrounding roughness) arise, to the extent that these can even be almost completely suppressed. In addition, the peak-to-valley height values obtained are particularly favorable for the application of resist layers. These surface properties can be achieved without particularly large additional investment in process engineering and apparatus.

The present invention is explained in more detail by reference to the following examples, which are not intended to be restrictive of the described embodiments of the present invention.

EXAMPLES 1 TO 16 AND 19 TO 20, AND COMPARISON EXAMPLES 17 AND 18

Descaled and degreased steel sheets, 40×60 cm in size and 0.28 cm in thickness, were used. The sheets were immersed in a solution having the composition of the electrolyte (described below) to remove any pickling residues present. Steel grades having the following composition were used in Examples 1 to 18:

Cr <0.1%
Mn 0.2%
Cu <0.1%
C <0.1%

In Examples 19 and 20, the Mn content was 0.4%, while the other constituent values were as reported for Examples 1 to 18.

The sheets were roughened and chromium-plated under the conditions indicated in the following table:

| Example No. | Chromic Acid g/l | Chloride added type | Chloride added g/l | Sulfuric acid g/l | Strontium sulfate g/l | a.c. density A/dm² | Time sec | d.c. density A/dm² | Time sec | Quality | Rz µm |
|---|---|---|---|---|---|---|---|---|---|---|---|
| 1 | 50 | NaCl | 12,5 | 1,75 | 20 | 37,5 | 40 | 30 | 75 | 1 | 4,2 |
| 2 | 50 | NaCl | 12,5 | 1,75 | 20 | 40 | 35 | 20 | 75 | 1 | 4,5 |
| 3 | 50 | NaCl | 12,5 | 1,75 | 20 | 50 | 30 | 20 | 75 | 2 | 5,1 |
| 4 | 50 | NaCl | 12,5 | 1,75 | 20 | 60 | 25 | 20 | 75 | 1–2 | 4,8 |
| 5 | 50 | NaCl | 12,5 | 1,75 | — | 40 | 35 | 40 | 50 | 1–2 | 4,2 |
| 6 | 50 | NaCl | 12,5 | 1,75 | — | 40 | 35 | 60 | 33 | 1–2 | 4,3 |
| 7 | 100 | NaCl | 25 | 2,5 | — | 60 | 25 | 20 | 75 | 2 | 5,9 |
| 8 | 100 | NaCl | 25 | 2,5 | — | 60 | 25 | 40 | 37 | 2 | 6,1 |
| 9 | 200 | NaCl | 50 | 5 | — | 20 | 100 | 20 | 50 | 1–2 | 7,9 |
| 10 | 200 | NaCl | 50 | 5 | — | 20 | 60 | 20 | 50 | 1–2 | 5,6 |
| 11 | 300 | NaCl | 75 | 7,5 | — | 20 | 100 | 20 | 70 | 2 | 8,3 |
| 12 | 300 | NaCl | 75 | 7,5 | — | 20 | 60 | 20 | 70 | 2 | 6,4 |
| 13 | 100 | HCl | 8 | 2,5 | — | 70 | 20 | 30 | 40 | 2 | 6,0 |
| 14 | 100 | HCl | 8 | 2,5 | — | 80 | 16 | 30 | 40 | 2 | 5,3 |
| 15 | 50 | NaCl | 12,5 | 1,75 | — | 40 | 35 | 20 | 75 | 2 | 4,6 |
| 16 | 50 | NaCl | 12,5 | 1,75 | — | 50 | 30 | 20 | 75 | 2–3 | 5,0 |
| V17 | 50 | NaCl | 12,5 | 1,75 | 20 | — | — | 20 | 75 | 4 | 2,8 |
| V18 | 50 | NaCl | 12,5 | 1,75 | 20 | — | — | 20 | 75 | 4 | 2,6 |

-continued

| Example No. | Chromic Acid g/l | Chloride added type | Chloride added g/l | Sulfuric acid g/l | Strontium sulfate g/l | a.c. density A/dm² | Time sec | d.c. density A/dm² | Time sec | Quality | Rz μm |
|---|---|---|---|---|---|---|---|---|---|---|---|
| 19 | 50 | $FeCl_3$ | 15 | 1,75 | 20 | 30 | 40 | 20 | 50 | 1–2 | 4,7 |
| 20 | 50 | $NaCl_3$ | 15 | 1,75 | 20 | 40 | 30 | 20 | 50 | 1 | 4,5 |

The quality of the resultant roughening was established visually by means of a microscope. The results (surface topographies) were classified in 10 quality ratings, and a completely homogeneously roughened and scar-free surface was given the quality rating "1". The quality rating "10" corresponds to a surface roughened in a completely irregular manner (i.e., with very different peak-to-valley heights) and/or a surface which shows thick scars of more than 100 μm depth.

The peak-to-valley height was determined by means of a peak-to-valley height-measuring instrument (Perthometer C5D). The indicated mean peak-to-valley height values ($R_z$) were obtained from measurements at 10 different points of each sample.

As can be seen from the tabulated data, both the surface topography and the peak-to-valley height values obtained, in accordance with the present invention, by an alternating-current/direct-current treatment in the same electrolyte are substantially improved over a pure direct-current treatment.

PREPARATION OF PRINTING PLATES

The plate treated according to Example 1 was subjected to a rinsing stage with water, in order to remove adhering electrolyte, and then was dried. The roughened and chromium-plated plate was provided with a positive-working resist layer comprising:

6.6 parts by weight of a cresol/formaldehyde novolak (having a softening range of 105°–120° C., according to DIN 53,181), 1.1 parts by weight of 4-(2-phenyl-prop-2-yl)-phenyl 1,2-naphthoquinone-2-diazide-4-sulfonate, 0.6 part by weight of 2,2'-bis-1,2-naphthoquinone-2-diazide-5-sulfonyloxy-1,1'-dinaphthylmethane, 0.24 part by weight of 1,2-naphthoquinone-2-diazide-4-sulfochloride, 0.08 part by weight of crystal violet and 91.36 parts by weight of a mixture of 4 parts by volume of ethylene glycol monomethyl ether, 5 parts by volume of tetrahydrofuran and 1 part by volume of butyl acetate.

After exposure and development, it was possible with the plate thus produced to produce, without any faults occurring, about 80,000 prints.

What is claimed is:

1. A process for preparing a chromium-plated steel or steel-based substrate suitable for use as a lithographic printing plate support, comprising the steps of:

(A) plating said substrate with alternating current in an acid electrolyte bath containing chromium ions, chloride ions and sulfate ions with alternating current; and (B) in the same electrolyte bath, carrying out an electrochemical treatment of said substrate with direct current.

2. A process as claimed in claim 1, wherein said electrolyte bath has a concentration of chromium ion between about 10 and about 300 g/l.

3. A process as claimed in claim 2, wherein said concentration of chromium ion is between about 30 and about 100 g/l.

4. A process as claimed in claim 1, wherein said electrolyte bath further contains strontium ions.

5. A process as claimed in claim 4, wherein said electrolyte bath has a concentration of strontium ion of about 100 g/l or less.

6. A process as claimed in claim 1, wherein said electrolyte bath has a concentration of sulfate ion between about 0.1 and about 10 g/l.

7. A process as claimed in claim 1, wherein said electrolyte bath has a concentration of chloride ion between about 1 and about 50 g/l.

8. A process as claimed in claim 1, wherein said alternating current has a density between about 10 and about 150 A/dm².

9. A process as claimed in claim 8, wherein said density is between about 30 and about 100 A/dm².

10. A process as claimed in claim 1, wherein said direct current has a density between about 10 and about 100 A/dm².

11. A process as claimed in claim 10, wherein said density is between about 10 and about 70 A/dm².

12. A process as claimed in claim 1, wherein said electrolyte bath during said process has a temperature between about 20° and about 60° C.

13. A process as claimed in claim 1, wherein said substrate has a residence time in said electrolyte bath of between about 10 and about 300 seconds.

14. A process as claimed in claim 1, wherein said electrolyte bath has a flow velocity over said substrate of between about 5 and about 100 cm/second.

* * * * *